US007292696B2

(12) United States Patent
Saeki et al.

(10) Patent No.: US 7,292,696 B2
(45) Date of Patent: Nov. 6, 2007

(54) ELECTRET CAPACITOR MICROPHONE

(75) Inventors: Shinichi Saeki, Kashiwara (JP); Hirofumi Yamada, Sakai (JP)

(73) Assignee: Hosiden Corporation, Osaka (JP)

( * ) Notice: Subject to any disclaimer, the term of this patent is extended or adjusted under 35 U.S.C. 154(b) by 272 days.

(21) Appl. No.: 10/503,653

(22) PCT Filed: Jan. 30, 2003

(86) PCT No.: PCT/JP03/00943

§ 371 (c)(1),
(2), (4) Date: Aug. 5, 2004

(87) PCT Pub. No.: WO03/067924

PCT Pub. Date: Aug. 14, 2003

(65) Prior Publication Data

US 2005/0089180 A1 Apr. 28, 2005

(30) Foreign Application Priority Data

Feb. 6, 2002 (JP) ..... 2002-029429

(51) Int. Cl.
*H04R 25/00* (2006.01)

(52) U.S. Cl. ..... 381/175; 381/174; 181/158

(58) Field of Classification Search ..... 381/113, 381/122, 174–175, 191, 91; 367/181; 181/158
See application file for complete search history.

(56) References Cited

U.S. PATENT DOCUMENTS

| | | | | |
|---|---|---|---|---|
| 3,946,422 | A * | 3/1976 | Yagi et al. | 257/254 |
| 4,466,120 | A * | 8/1984 | Walker et al. | 381/109 |
| 6,914,992 | B1 * | 7/2005 | van Halteren et al. | 381/113 |

FOREIGN PATENT DOCUMENTS

| | | |
|---|---|---|
| JP | 02-35319 | 2/1990 |
| JP | 07-240424 | 9/1995 |
| JP | 10-098796 | 4/1998 |
| JP | 2001-078297 | 3/2001 |
| JP | 2001-102875 | 4/2001 |
| JP | 2001-231098 | 8/2001 |
| JP | 2003-526299 T | 9/2003 |

* cited by examiner

*Primary Examiner*—Suhan Ni
(74) *Attorney, Agent, or Firm*—The Webb Law Firm

(57) ABSTRACT

The present invention is an electret condenser microphone that includes an electro-acoustic transducer (M) having an electret portion (E) including a diaphragm (6) acting as an electrode and a stationary electrode (2, 25) disposed in opposition to the diaphragm (6), and a FET (10) effecting an impedance conversion on an output from the electro-acoustic transducer (M) and then outputting the converted output on a signal line (L). A capacitor (11) and a varistor (12) are provided in parallel between the signal line (L) and a ground (18) and a resistor (13) is incorporated in series in the signal line (L).

3 Claims, 7 Drawing Sheets

(a)

(b)

ELECTRET CAPACITOR MICROPHONE

TECHNICAL FIELD

The present invention relates to an electret condenser microphone of small power consumption and capable of rejecting noise over a broad band, the electret condenser microphone being suitable for use as e.g. a microphone in a mobile telephone or a sensor disposed inside an engine room of an automobile.

BACKGROUND ART

A conventional electret condenser microphone is known from Japanese Patent Application "Kokai" No.: Hei. 10-98796. According to this conventional art, sound holes and sound guiding holes are arranged with offset each other so as to prevent intrusion of noise from the outside. Further, for the purpose of rejecting high-frequency noise, a capacitor is interposed between an output terminal connected to a drain terminal and to a source terminal of an FET (Field Effect Transistor) and a ground terminal and also a coil is incorporated in a line from the output terminal. Many other conventional electret condenser microphones have a simpler circuit construction only providing the capacitor interposed between a signal line of the FET and the ground. And, as disclosed by Japanese Patent Application "Kokai" No.: Hei. 7-240424 for example, the conventional electret condenser microphones employ the junction type FET.

The electret condenser microphone having the constructions described above can be readily formed compact, so that it is widely used in a mobile telephone also. When used in a mobile telephone, the electret condenser microphone is to be driven by a battery. Hence, it is desired that the microphone consume as little power as possible. However, in the case of the junction FET, a current, though being small, runs between the signal line and the ground when a voltage is being applied thereto. Therefore, there remains room for improvement in terms of power consumption. In addition, the heat resistance of this junction FET is not very high, so that there is a desire for improvement in the respect of heat resistance also.

In the art of mobile telephone, a conventional digital communication system called GMS (Global System for Mobile Communication) employs frequency of 900 MHz. For high-frequency noise of such frequency, it was possible to reject noise of a particular frequency by allowing the noise to be "drained" from the signal line through the ground by effectively utilizing an impedance drop due to self-resonance of the above-described capacitor or by using a high-pass filter comprising a capacitor in combination with a coil.

However, in the case of a mobile telephone relying on a different system called TDMA (Time Division Multiple Access) for signal transmission, the frequency for its time division is set at the audio frequency. Therefore, there arises the inconvenience that this signal may be received by the signal line, thereby to develop an audio noise thereon. Especially, in the case of the dual-band system employed by more recent mobile telephones, noise rejection has been more complicated since two kinds of high-frequency noise have to be coped with at one time. Furthermore, for the mobile telephone using a high frequency required by the GMS system, there is a need for e.g. a new design change. Hence, there has been a need to cope with noise rejection.

Specifically, the conventional digital communication system called GSM system employs the frequency of 900 MHz.

In the case of the dual-band system, however, two frequencies of 1800 MHz and 1900 MHz are employed in combination or more recently two frequencies of 900 MHz and 1800 MHz are employed. Further, in a system called IMT2000, the used frequency is as high as 2 GHz.

An example of the conventional electret condenser microphone is illustrated in FIG. 8. With this conventional construction, the construction includes an electro-acoustic transducer M using an electret element in one of a stationary electrode comprising a front end face or back electrode of a capsule and a diaphragm functioning as an electrode and includes also a junction FET (Tr). The electro-acoustic transducer M is electrically coupled to a gate terminal G of the FET (Tr), a drain terminal D of the FET (Tr) is used as a signal line L and capacitor Con is incorporated between the signal line L and a ground (earth).

With the electret condenser microphone having this conventional construction, by appropriating setting a capacitance of the capacitor Con so that the impedance value of the capacitor Con may drop to its minimal at the particular frequency (900 MHz) employed by the GSM system (specifically, as graphically shown in FIG. 6 as "conventional product"), it is possible to reject noise by allowing high-frequency noise on the signal line L to be drained to the ground. However, even with this construction capable of rejecting high-frequency noise, if the high-frequency noise affects the construction in a cycle corresponding to the audio frequency as is the case with the TDMA system, there often develops on the signal line L an audible noise which has a similar waveform to that demodulated from this high-frequency noise. In particular, when the dual-band type mobile telephone employs the conventional electret condenser microphone, only one of the two kinds of high-frequency noise employed for communication can be rejected. Hence, there remains room for improvement in this respect.

The impedance behavior of the capacitor relative to the frequency can be graphically illustrated as in FIG. 9. From this figure, it may be understood that with the construction having one capacitor, in the dual band system employing the two linds of frequencies of 900 MHz and 1800 MHz, the capacitance of the single capacitor Con can be set so as to reduce its impedance for only one of the two frequencies. It is not possible to reject high-frequency noise of the other frequency for which the impedance is not reduced. As may be apparent from this, with the conventional electret condenser microphone implementing a capacitor alone or using a high-pass filter, it is not possible to cope with noise of these frequencies. Therefore, there has been a need for an electret condenser microphone capable of rejecting noise over a broad band.

The object of the present invention is to construct an electret condenser microphone in a rational manner, which microphone consumes only small power and which is capable of rejecting noise over a broad band.

DISCLOSURE OF THE INVENTION

According to the characterizing feature of an electric condenser microphone relating to claim 1 of the present invention, an electric condenser microphone comprises: an electro-acoustic transducer (M) having an electret portion (E) provided at least one of a diaphragm (6) acting as an electrode and a stationary electrode (2, 25) disposed in opposition to the diaphragm (6), and an FET (10) effecting an impedance conversion on an output from the electro-acoustic transducer (M1) and then outputting the converted output, wherein said FET (10) comprises a MOS type.

According to such characterizing feature, the electret condenser microphone employs the MOS type FET (10) which provides an impedance of a higher value between terminals connected to the signal line (L) and the ground (18) than the junction type FET. Hence, even when the microphone is used in the condition with application of a voltage between this signal line (L) and the ground (18), the current running between the signal line (L) and the ground (18) is extremely small. In addition, since this MOS FET (10) has a higher heat resistance than the junction FET, the microphone can be used also under a high-temperature environment. Specifically, while the conventional junction type FET can withstand a heat up to about 85° C., the MOS type FET (10) can operate properly in an atmosphere at about 120° C. Therefore, the microphone can be used not only in a mobile telephone, but also as a sensor or the like to be disposed inside an engine room of an automobile. Consequently, there is provided an electret condenser microphone which achieves lower power consumption as well as usability under a high-temperature environment.

According to the characterizing feature of the electret condenser microphone relating to claim 2, in the electret condenser microphone defined in claim 1, a capacitor (11) and a varistor (12) are provided in parallel between the signal line (L) of the FET (10) and the ground (18) and a resistor (13) is incorporated in series in the signal line (L1).

With such characterizing feature above, when the signal line (L) is affected by a high-frequency noise from outside, the impedance of the capacitor (11) will drop in proportion with that frequency, whereby this noise will be drained to the ground (18). At the same time, if this high-frequency noise causes the voltage of the signal line (L) to rise, the resistance value of the varistor (12) is reduced, so that the noise on the signal line (L) is drained to the ground (18). Namely, simultaneously with the rejection of high-frequency noise by the capacitor (11), when a voltage develops on the signal line (L) due to the effect of external noise, the varistor (12) is effectively employed for broad-band rejection of that noise regardless of its frequency. Moreover, since the resistor (13) is incorporated in series in the signal line (L), this resistor (13) serves to attenuate the noise, and also when static electricity suddenly affects the signal line (L) due to electrostatic discharge (ESD), the varistor (12) causes this static electricity to be drained to the ground (18). At the same time, the resistor (13) serves to reduce the voltage of this static electricity. As a result, the voltage to be applied to the FET (10) is reduced, thereby to protect this FET (10). In this way, there is achieved in a rational manner an electret condenser microphone capable of rejecting noise over a broad band including not only high-frequency but also audio frequency and capable also of providing effective protection of the FET (10) against electrostatic discharge.

According to the electret condenser microphone relating to claim 3 of the invention, in the electret condenser microphone defined in claim 2, said ground (18) is formed as a ring of a metal foil on a substrate (P), said MOS FET (10) and said signal line (L) formed of a metal foil electrically coupled to an output terminal (D) of said MOS FET (10) are formed on a portion of the substrate surrounded by said ground (18); and said capacitor (11) and said varistor (12) are provided between said signal line (L) and said ground (18).

With such characterizing feature as above, since the MOS type FET (10), the capacitor (11) and the varistor (12) are disposed in the portion or area surrounded by the ground (18) formed as a ring of metal foil on the substrate (P), even under a condition affected by an external noise, a portion of such noise can be absorbed by the ground (18), thereby to reduce the potential to be applied to the signal line (L). As a result, noise can be reduced and also the FET (10) can be protected.

According to the characterizing feature of the electret condenser microphone relating to claim 4 of the invention, in the electret condenser microphone defined in claim 2 or 3, the microphone further comprises a metal capsule (C) having sound holes (1) at one end and the other end being open; said diaphragm (6) is incorporated within the capsule (C) on the side of the sound holes (1), said substrate (P) is fixedly fitted to the other end of the capsule (C) thereby to close said other open end, and said MOS FET (10), said capacitor (11) and said varistor (12) are provided on the inner side of said substrate (P) inside the capsule (C).

With such characterizing feature as above, the open portion of the capsule (C) is closed with the substrate (P), so that entrance of dust to the inside of the capsule (C) can be prevented. Moreover, as the MOS FET (10), the capacitor (11) and the varistor (12) are all disposed on the inner side of the substrate (C) located inside the capsule (C), the capsule (C) and the substrate (P) can serve as "shields", so that noise coming into the capsule (C) from the outside can be reduced significantly. As a result, there is achieved an electret condenser microphone capable of rejecting noise even more effectively.

BEST MODE FOR EMBODYING THE INVENTION

Next, embodiments of the present invention will be described with reference to the drawings.

Figure 1:
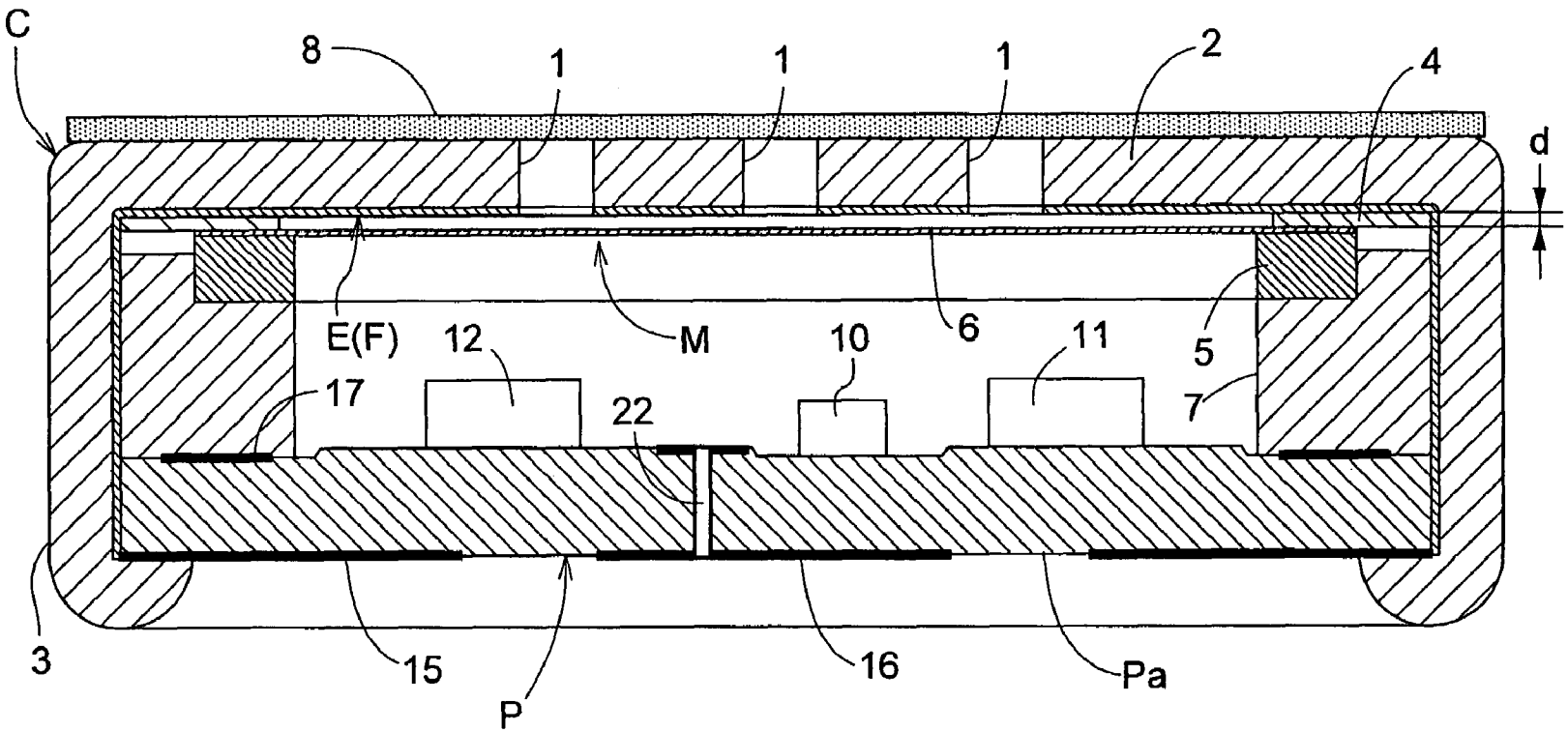
FIG. 1 is a section view showing an electret condenser microphone relating to one embodiment of the present invention.
Figure 2:
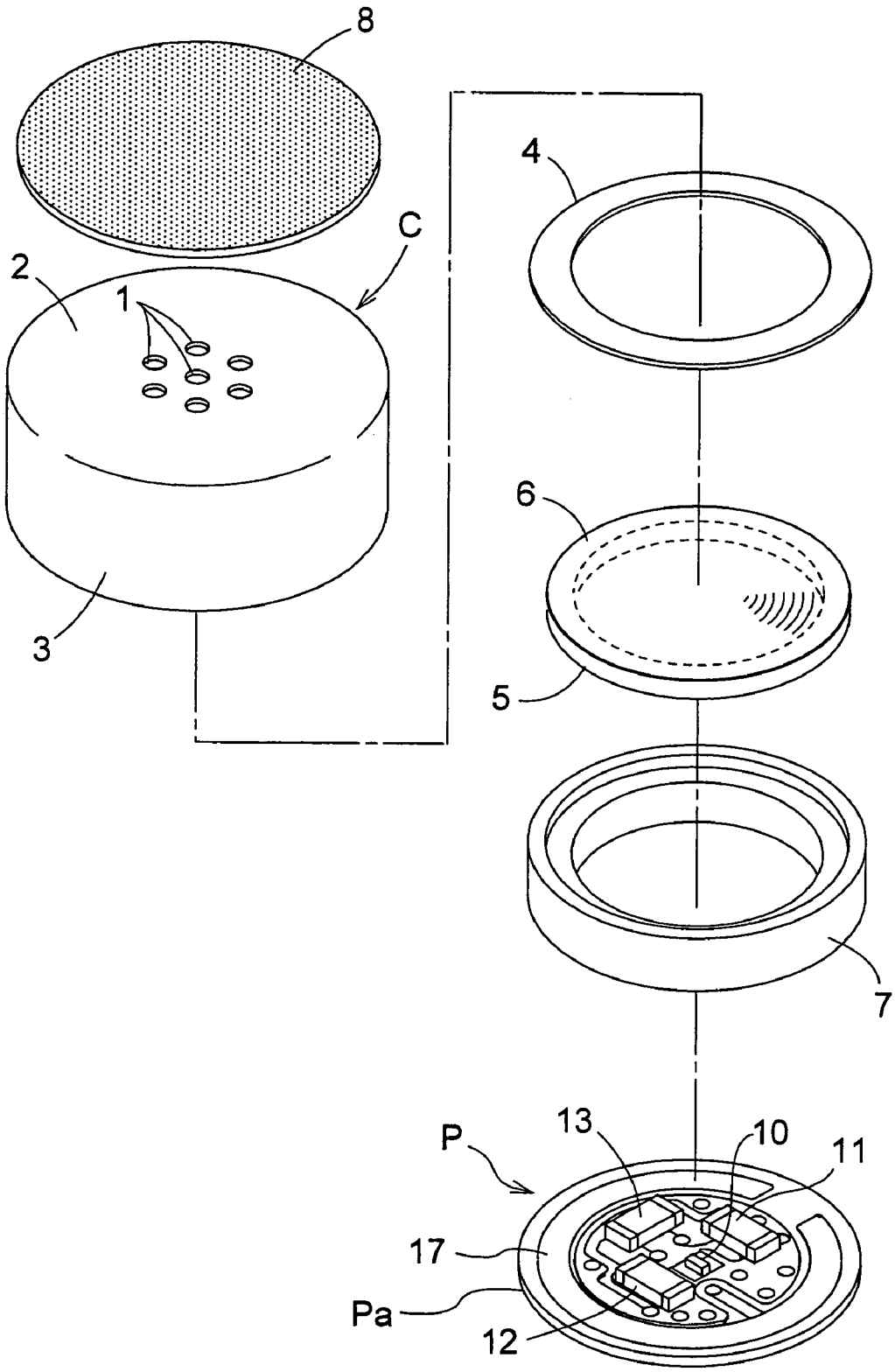
FIG. 2 is an exploded perspective view of this electret condenser microphone.
Figure 3:
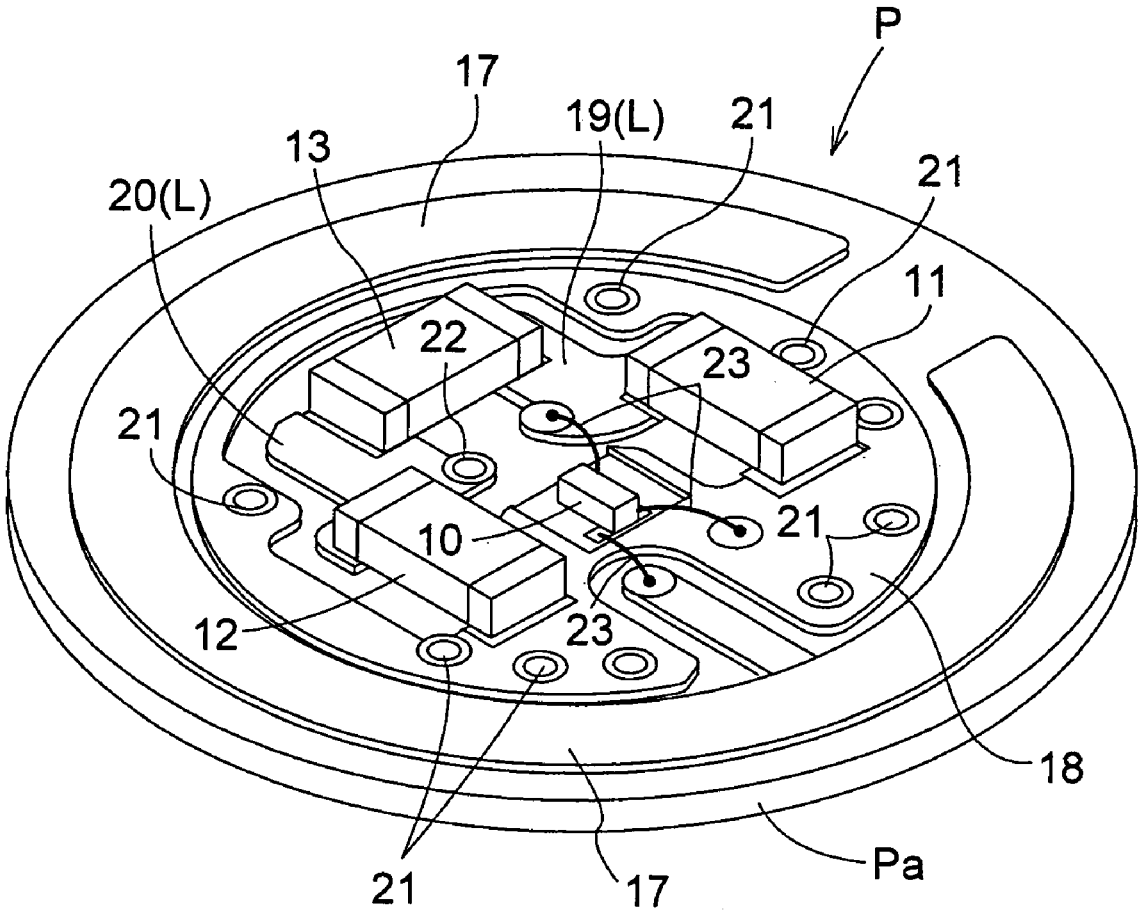
FIG. 3 is a perspective view of a substrate of this electret condenser microphone.

As shown in FIG. 1 and FIG. 2, an electret condenser microphone relating to this embodiment comprises a capsule C including a front-end wall 2 having a plurality of sound holes 1 and acting as a stationary electrode and a cylindrical lateral wall 3, with a side of the capsule C opposed to the front-end wall 2 being open. An electret portion E is formed on an inner side of this capsule C. The microphone further includes, inside the capsule C, an annular isolating spacer 4, a conductive diaphragm 6 supported to a conductive support ring 5 and acting as an electrode, and a cylindrical conductive ring 7. Further, a filter 8 made of non-woven fabric or textile is provided on the outer side of the front-end wall 1 of the capsule C. And, adjacent the open side of the capsule C, there is provided a substrate P mounting thereon a MOS type FET 10, a capacitor 11, a varistor 12 and a resistor 13 as shown in FIG. 3. Hence, this electret condenser microphone is constructed as a front type electret condenser microphone.

The MOS type FET 10 mentioned above refers to a field effect transistor having an oxide coating on a surface of silicon, which transistor can be either the depletion type or the enhancement type. In the case of the electret condenser microphone relating to this particular embodiment, however, the enhancement type is employed which consumes less power and also provides higher heat resistance. In particular, advantageously, this MOS FET 10 comprises one manufactured by a sub-micron process and designed for audio use for amplification of sound signals. Further, in the present embodiment, an N-channel MOS FET 10 is contemplated for use as will be described later. It should be noted, however, that same effect can be achieved also when the present invention employs a P-channel type MOS FET 10 instead. Hence, the electret condenser microphone according to the present invention can be constructed by using either the N-channel or P-channel MOS FET.

This electret condenser microphone includes an electro-acoustic transducer M which picks up vibration of the diaphragm 6 corresponding to acoustic vibration caused by a sound introduced through the sound holes 1 as variation in capacitance between the front-end wall 2 of the capsule C and the diaphragm 6, which are caused to function as capacitors. Then, this variation in the capacitance of the electro-acoustic transducer M is subject to an impedance conversion through the FET 10 to be outputted as a corresponding electric signal.

The capsule C can be formed in a manner described next. Namely, a polymer film such as of FEP (Fluoro Ethylene Propylene) is superposed on a metal plate of aluminum or the like having good malleability. The resultant assembly is subsequently heated and pressed, whereby a polymer film coating F is formed on the metal plate. Thereafter, the front-end wall 2 and the cylindrical lateral wall 3 are formed integrally, by means of a reducing work technique. Next, a work is done for forming the plurality of sound holes 1 in the front-end wall 2. Further, the inner surface of the capsule C is subjected to a polarization process by means of electron beam polarization or corona charge, whereby the electret portion E permanently maintaining the electrically polarized state is formed on the inner face of the front-end wall 2 of the case C.

The spacer 4 is configured as a ring-like element having an outer diameter suitable to be fitted within the inner face of the lateral wall 3 of the case. Also, as shown in FIG. 1, this spacer 4 is formed of an insulating resin material to provide a thickness (d), e.g. about 25 μm, which is equal to an appropriate spacing between the front-end wall 2 and the diaphragm 6.

The diaphragm 6 comprises a resin film of e.g. polyethylene terephthalate or polyphenylene sulfide and a conductive layer formed thereon by vacuum evaporation of a metal such as nickel, aluminum etc. Then, by means of a conductive adhesive, this diaphragm 6 is bonded and supported to a support ring 5 formed of a good conductor such as copper, copper alloy, etc. In supporting this diaphragm 6 to the support ring 5, advantageously, a tension is applied to such a extent to render this diaphragm 6 slightly tense. The conductive ring 7 is formed as a cylindrical member made of a good conductor such as copper, copper alloy or the like, the cylindrical member having an outer diameter which allows snug fitting thereof to the inner side of the lateral wall 3 and allows also its contact with the rear side of the support ring 5. With the resultant contact between the conductive ring 7 and the support ring 5, there is established an electric conduction with the diaphragm 6.

Figure 4:
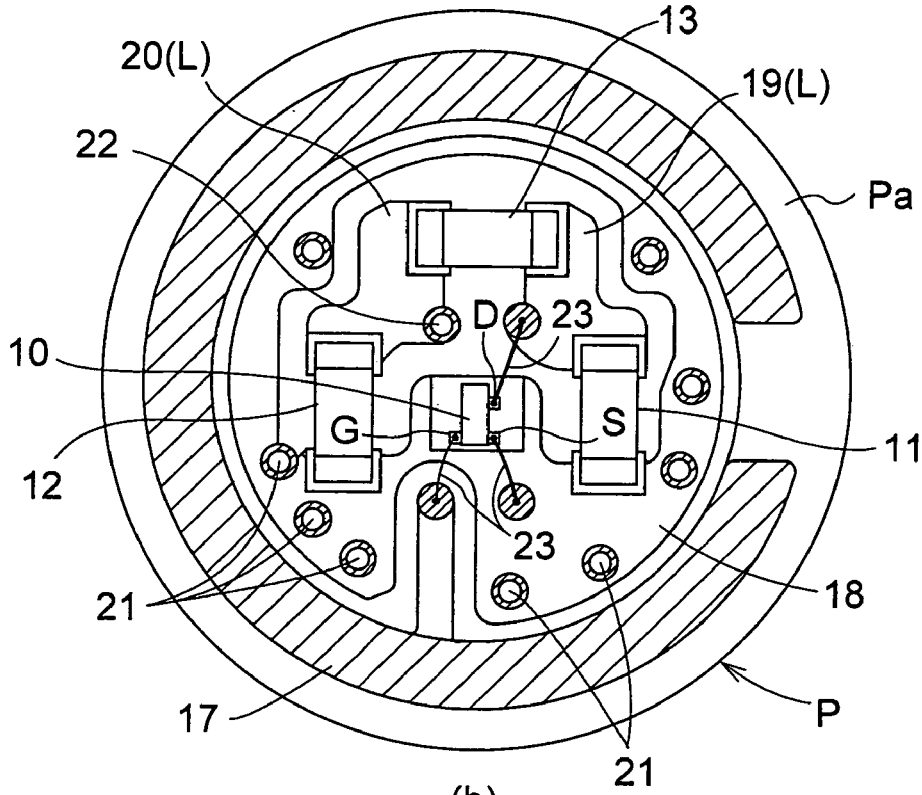
FIG. 4 is a view showing an inner side and an outer side of this substrate.
Figure 4:
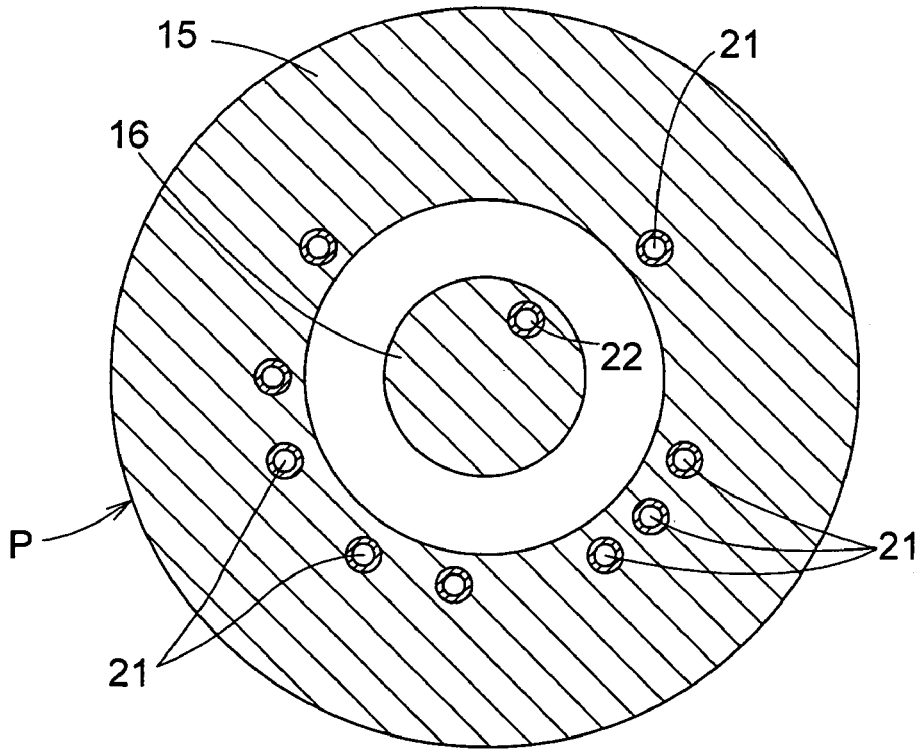

The substrate P comprises a non-conductive substrate base Pa formed of e.g. glass epoxy. On each of the inner side (front side) and the outer side (rear side) of this substrate base Pa, there is provided a printed circuit formed in a predetermined pattern by e.g. etching of a good conductor such as a copper foil, as illustrated in FIGS. 3 and 4. More particularly, as shown in FIG. 4(*b*), on the outer side of the substrate P, there are formed an annular outer contact portion 15 which contacts when the lateral wall 3 of the case C is folded inwards and an output portion 16 located at the center position. Further, as shown in FIG. 3 and FIG. 4(*a*), on the inner side of the substrate P, there are formed an annular inner contact portion 17 which comes into contact with the conductive ring 7 and an annular ground 18 located within the inner contact portion 17. In addition, within this ground 18, there are formed a first conductive portion 19 and a second conductive portion 20 independently of each other. Further, the ground 18 is electrically coupled to the outer contact portion 15 through a plurality of through holes 21. The first conductive portion 19 and the second conductive portion 20 form a signal line L and the second conductive portion 20 is electrically coupled to the output portion 16 via the through holes 22.

As shown in FIG. 4, at the center position of the inner side of the substrate P and mounted on the ground 18, the MOS type and enhancement type FET 10 is fixed there by means of an adhesive agent. And, a gate terminal G of this FET 10 and its projecting portions to be electrically coupled to the inner contact portion 17 are bonded together by means of bonding wires 23 respectively. Further, a chip type capacitor 11 is conductively interposed between the first conductive portion 19 and the ground 19, a chip type varistor 12 is conductively interposed between the second conductive portion 20 and the ground 18, and a chip type resistor 13 is conductively interposed between the first conductive portion 19 and the second conductive portion 20. Incidentally, the chip capacitor 11, the chip varistor 12 and the chip resistor 13 are first mounted at the above-described respective mounting positions by means of cream solder and then fixed under the soldered condition through a reflow processing.

The chip type capacitor 11 employed comprises one having a capacitance suitable for noise rejection (e.g. which provides the lowest impedance at the particular frequency used by the GMS system). The chip varistor 12 employed comprises one whose varistor voltage has a value slightly higher than a voltage to be impinged between a drain terminal D and a source terminal S of the FET 10. The chip resistor 13 employed comprises one having a resistance value suitable for noise rejection.

For assembling this electret condenser microphone, first, the spacer 4, the diaphragm 6 supported to the support ring 5 and the conductive ring 7 will be fitted inside the case C having the electret portion E formed in the manner described above. Next, the substrate P mounting thereon the FET 10, the chip capacitor 11, the chip varistor 12 and the chip resistor 13 will be fitted into the rear end opening of the case C. Thereafter, in order to permanently fix the substrate P to the case C, a reducing operation will be effected for bending inward the ends of the lateral wall 3 of the case C. When this assembly operation is completed, a spacing (of e.g. 25 μm) equal to the thickness (d) of the spacer 4 is formed between the front-end wall 2 and the diaphragm 6 and also the film coating F formed on the inner side of the lateral wall 3 of the case C electrically insulates the outer peripheral face of the conductive ring 7 from the lateral wall 3 of the case C. With this electret condenser microphone completed in the manner described above, the inner contact portion 17 formed on the inner side of the substrate P contacts the conductive ring 7 thereby to establish electrical connection therebetween, and also the outer contact portion 15 formed on the outer side of the substrate P contacts the lateral wall 3 of the case C thereby to establish electric connection therebetween. Hence, an electric conduction is established between these components and the circuit on the substrate, so that a variation in capacitance developed between the front-end face 2 of the case C and the diaphragm 6 can be obtained and outputted as an electric signal from the output portion 16.

Figure 5:
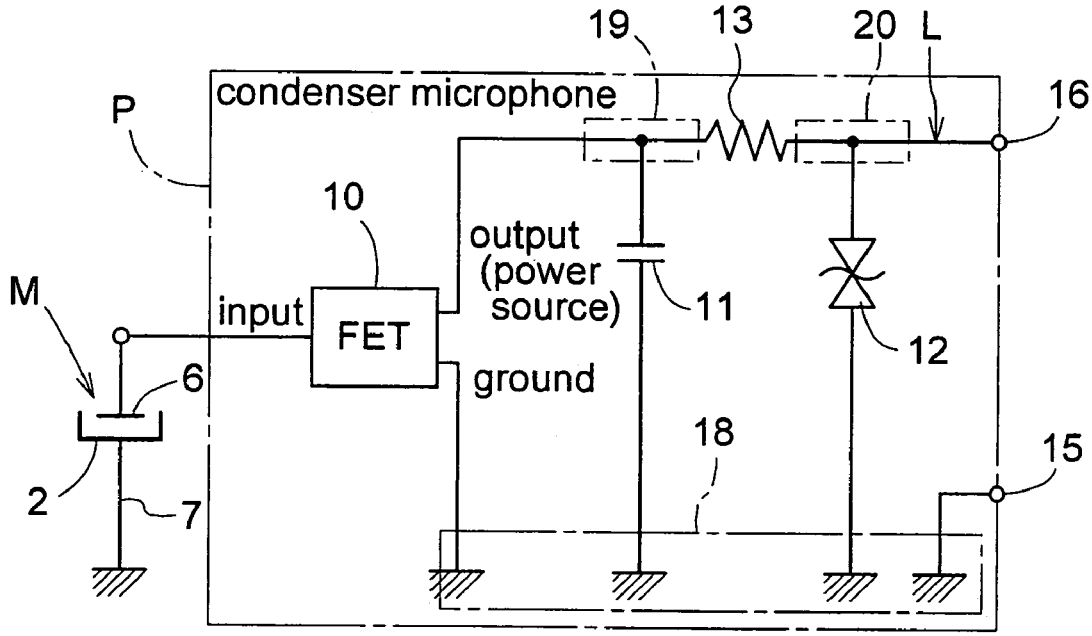
FIG. 5 is an electric circuit diagram of this electret condenser microphone.

Incidentally, the electric circuit of this electret condenser microphone can be diagrammatically represented as illustrated in FIG. 5. In this figure, in case the N channel MOS FET 10 is employed, "input" corresponds to the gate G, "output" corresponds to the drain D and "ground" corresponds to the source S, respectively.

Figure 6:
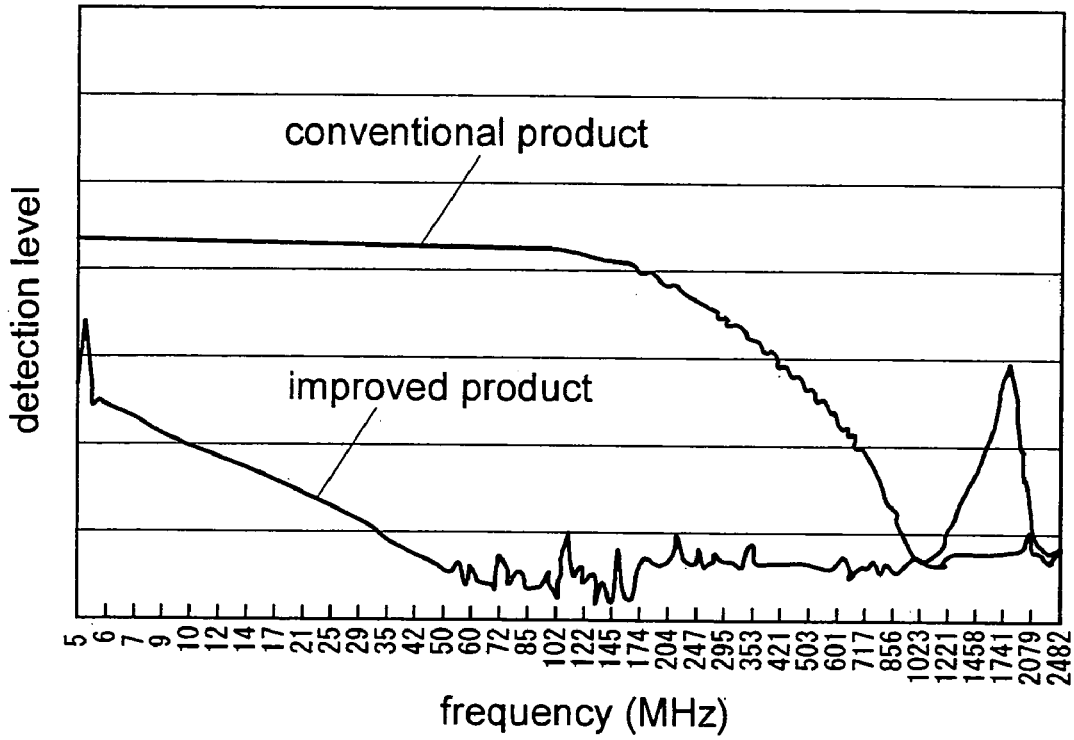
FIG. 6 is a graph for comparing noise levels between the electret condenser microphone relating to the present invention and a conventional product.
Figure 8:
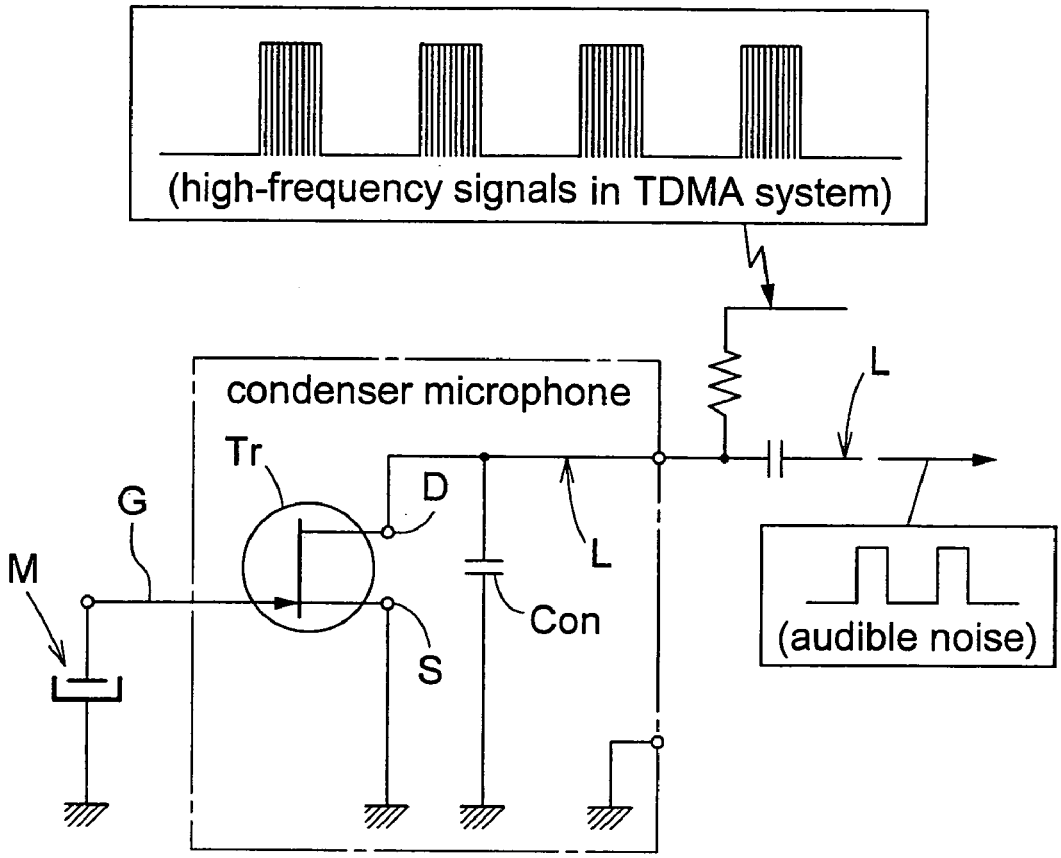
FIG. 8 is a diagram showing a construction of a conventional electret condenser microphone.
Figure 9:
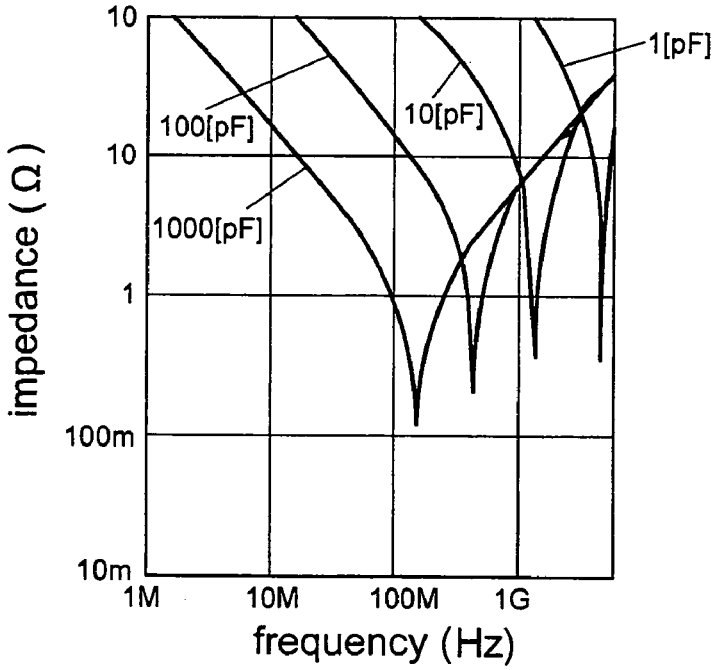
FIG. 9 is a graph showing impedance of a capacitor for various frequencies.

FIG. 6 graphically shows results of measurements on noises (represented as detection levels) appearing on the signal line L under an environment affected by high-frequency noise in comparison between the electret condenser microphone of the invention having the above-described construction and the conventional electret condenser microphone (conventional product) such as the one shown in FIG. 8. As may be clearly seen in this figure, in the case of the conventional electret condenser microphone (conventional product), a high detection level is maintained up to about 100 MHz, the detection level then decreases at frequencies higher than about 100 MHz and the detection level decreases most significantly at 900 MHz which corresponds to the frequency employed by the GSM system. On the other hand, in the case of the electret condenser microphone according to the present invention (improved product), the detection level is lower as a whole. And, the detection level decreases as the frequency rises to about 60 MHz. And, the detection level is maintained still low even in the frequency range higher than the frequency of 60 MHz.

In this way, with the electret condenser microphone relating to the present invention, as this microphone includes the MOS FET 10, the capacitor 11, the varistor 12 and the resistor 13 mounted on the substrate P, even when an external noise is applied to the signal line L, the impedance is reduced due to the self-resonance of the capacitor 11, so that this noise is eliminated by being drained to the ground 18. Further, when the voltage of the signal line L is raised by the effect of this noise, as the resistance value of the varistor 12 is reduced for nose in broad band, the noise on the signal line L can be rejected again by being drained to the ground 18. In addition, the resistor 13 provides the function of lowering the level of signal flowing in the signal line L. Also, with this electret condenser microphone, the electro-acoustic transducer M, the MOS FET 10, the capacitor 11, the varistor 12 and the resistor 13 are all accommodated under the shielded condition thereof inside the capsule C and moreover, on the substrate P, the MOS FET 10, the capacitor 11, the varistor 12, the resistor 13 and the signal line L are all disposed within its surface area surrounded by the ground 18. Hence, the level of such external noise can be reduced significantly.

With the provision of the above-described construction, when this microphone is employed in a frequency-switchover type mobile telephone such as one implementing the dual-band system, high frequency noise due to the two frequencies can be rejected effectively. In addition, even when the microphone is subjected to a nose in the audible frequency range as in the TDMA system, the MOS type FET 10 designed for audio use can reject such noise which generates an annoying audible sound. In this way, the microphone can reduce not only noise of high frequency, by also nose of broad band including audible frequencies.

In particular, as compared with the junction FET, the MOS FET 10 provides a higher impedance between the drain terminal D and the source terminal S. Hence, only a very small amount of current flows even when a voltage is impinged thereto. So that, there occurs no wasteful power consumption. Specifically, the power consumption can be reduced to ⅓ approximately. Moreover, the standard MOS type FET 10 provides a high heat resistance as high as up to about 130° C. This enables its use in a high-temperature environment such as in an engine room of an automobile.

OTHER EMBODIMENT

In addition to the foregoing embodiment, the present invention can be embodied by providing the characterizing features of the invention in an electret condenser microphone having such constructions as described next. In the following discussion of the further embodiment, the components having substantially same functions as those in the foregoing embodiment will be denoted and described with same reference numerals and marks as the foregoing embodiment.

(1) A front electret condenser microphone employs the same arrangement as the electret condenser microphone shown in FIG. 1 and employs also a diaphragm 6 which is formed of a metal foil such as of nickel or the like.

Figure 7:
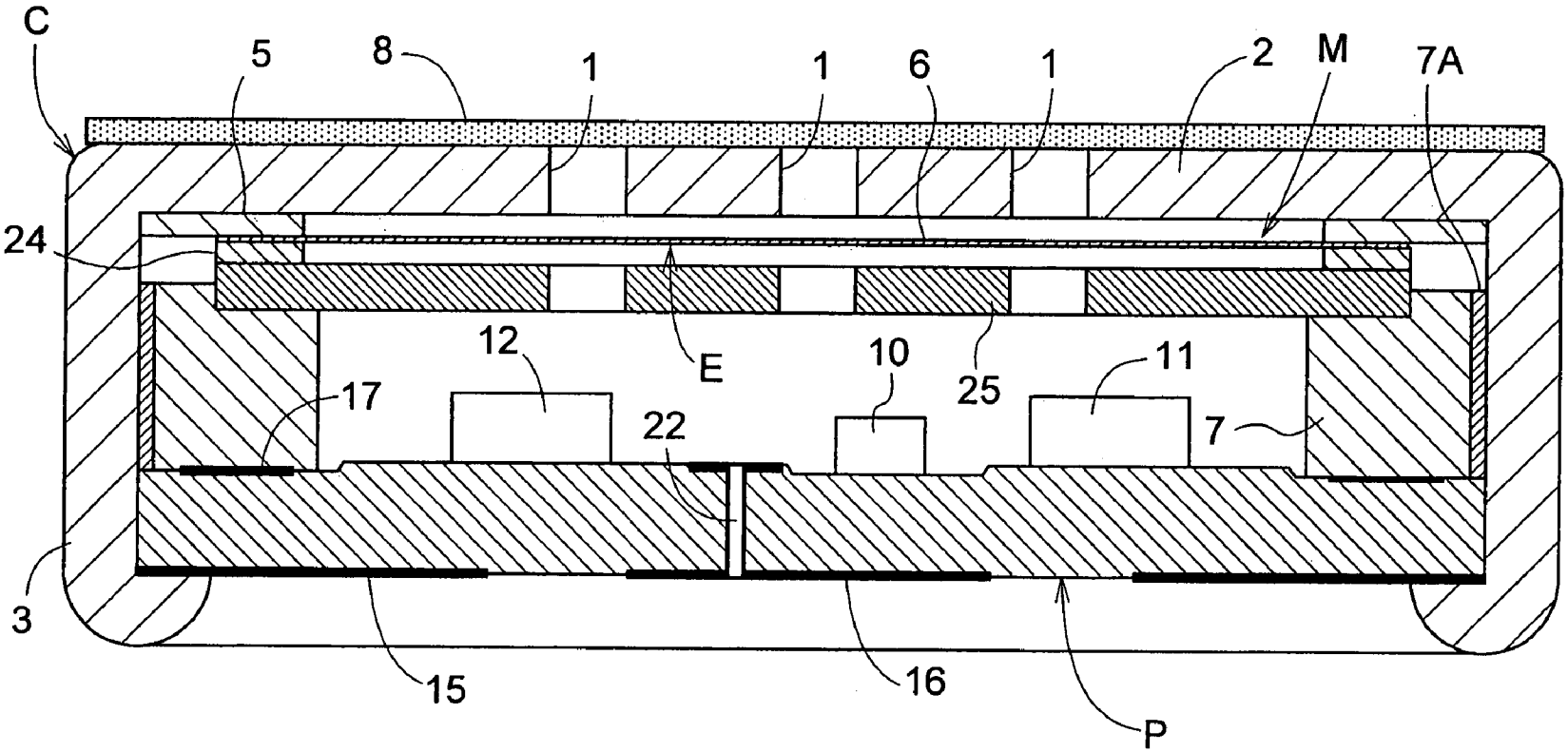
FIG. 7 is a section view showing an electret condenser microphone relating to a further embodiment of the present invention.

(2) As shown in FIG. 7, a front electret condenser microphone includes a metal capsule C, a diaphragm 6 supported to a metal support ring 5 and having a metal-evaporated and permanently electrically charged polymer film, an insulating ring 24 formed of an insulator a metal back electrode 25, and a conductive ring 7 electrically coupled with the back electrode 25 and having an insulating film 7A around its outer periphery, and includes also a substrate P mounting thereon the MOS FET 10, the chip capacitor 11, the chip varistor 12 and the chip resistor 13 like the foregoing embodiment. In this construction, however, the electret portion E is formed on one side of the diaphragm 6 opposed to the back electrode 25. In operation, an acoustic vibration of the diaphragm 6 resulting from a sound introduced through the sound holes 1 is processed through the electro-acoustic transducer M as a variation in the capacitance between the back electrode 25 and the diaphragm 6 and outputted via the substrate P. And, in the case of this construction too, like the foregoing embodiment, noise on the signal line L is reduced by means of the MOS FET 10, the chip capacitor 11, the chip varistor 12 and the chip resistor 13.

(3) A back type condenser microphone employs the same arrangement as the electret condenser microphone shown in FIG. 7 and in this case, a side of the back plate 25 opposed to the diaphragm 6 is electrically charged.

Needless to say, in any one of the three kinds of electret condenser microphones relating to this further embodiment, it is possible to embody the invention by implementing the substrate P having the printed circuit described in the foregoing embodiment and/or implementing the construction in which the entire circuit construction is accommodated within a metal capsule C. Therefore, the above-described functions and effects of the present invention can be achieved fully also when the invention is embodied in any one of the three kinds of modes described in this further embodiment.

INDUSTRIAL APPLICABILITY

The electret condenser microphone relating to the present invention consumes only small power and can reject noise over broad band. Hence this microphone can be suitably used as a microphone in a mobile telephone. Further, as this electret condenser microphone can be used even under a high-temperature environment, this can be suitably used also as e.g. a sensor to be disposed inside an engine room of an automobile.

The invention claimed is:

1. An electret condenser microphone comprising an electro-acoustic transducer (M) having an electret portion (E) having at least one of a diaphragm (6) acting as an electrode and a stationary electrode (2, 25) disposed in opposition to the diaphragm (6), and a FET (10) effecting an impedance conversion on an output from the electro-acoustic transducer (M) and outputting the converted output on a signal line (L), wherein:

said FET (10) comprises a MOS type;

a capacitor (11) and a varistor (12) are provided in parallel between said signal line (L), which is coupled to one output terminal (D) of said FET (10), and a ground (18) coupled to the other output terminal (S) of said FET (10); and a resistor (13) is incorporated in series in said signal line (L).

2. The electret condenser microphone according to claim 1, wherein said ground (18) is formed as a ring of a metal foil on a substrate (P), said FET (10) and said signal line (L) formed of a metal foil electrically coupled to the one output terminal (D) of said FET (10) are formed on a portion of the substrate surrounded by said ground (18); and said capacitor (11) and said varistor (12) are provided between said signal line (L) and said ground (18).

3. The electret condenser microphone according to claim 2, further comprising a metal capsule (C) having sound holes (1) at one end and the other end being open; said diaphragm (6) is incorporated within the capsule (C) on the side of the sound holes (1), said substrate (P) is fixedly fitted to the other end of the capsule (C) thereby to close said other open end, and said FET (10), said capacitor (11) and said varistor (12) are provided on the inner side of said substrate (P) inside the capsule (C).

* * * * *